United States Patent [19]

Manning et al.

[11] 3,986,359

[45] Oct. 19, 1976

[54] THERMODYNAMIC ENGINE SYSTEM AND METHOD

[75] Inventors: Lindley Manning; Richard N. Schneider, both of Reno, Nev.

[73] Assignee: Cryo Power, Inc., Reno, Nev.

[22] Filed: May 29, 1973

[21] Appl. No.: 364,780

[52] U.S. Cl. ..... 60/508; 60/509; 60/671

[51] Int. Cl.[2] ..... F03G 7/06

[58] Field of Search ..... 60/36, 38, 73, 509, 60/650, 659, 655, 682, 641, 670, 671, 644, 651, 656, 643, 645; 62/6, 324, 401; 290/2; 418/83, 85

[56] References Cited

UNITED STATES PATENTS

| | | | |
|---|---|---|---|
| 1,023,819 | 4/1912 | Danckwardt | 60/38 UX |
| 1,032,236 | 7/1912 | Patten | 60/38 UX |
| 1,460,487 | 7/1923 | Hawkins | 418/83 |
| 1,558,639 | 10/1925 | Schmied | 418/83 |
| 1,895,816 | 1/1933 | Pfeiffer | 418/83 X |
| 2,073,188 | 3/1937 | Westin | 418/85 X |
| 2,539,255 | 1/1951 | Karrer et al. | 60/655 |
| 2,593,963 | 4/1952 | Biggs | 60/655 |
| 2,597,249 | 5/1952 | Kollsman | 62/6 UX |
| 3,001,482 | 9/1961 | Osborn | 418/85 |
| 3,252,286 | 5/1966 | Whitelaw | 60/644 X |
| 3,257,806 | 6/1966 | Stahl | 60/38 X |
| 3,451,342 | 6/1969 | Schwartzman | 60/641 X |
| 3,531,933 | 10/1970 | Baldwin | 60/36 |
| 3,589,126 | 6/1971 | Zotto | 60/671 X |
| 3,613,385 | 10/1971 | Hogan et al. | 62/6 |
| 3,786,631 | 1/1974 | Manning et al. | 60/641 |
| 3,826,096 | 7/1974 | Hrusch | 60/656 X |
| 3,842,333 | 10/1974 | Boese et al. | 60/671 X |

FOREIGN PATENTS OR APPLICATIONS

| | | | |
|---|---|---|---|
| 27,153 | 12/1898 | United Kingdom | 60/671 |

*Primary Examiner*—Allen M. Ostrager
*Assistant Examiner*—Harold Burks
*Attorney, Agent, or Firm*—Townsend and Townsend

[57] ABSTRACT

A highly efficient, pollution free thermodynamic engine employing a primary cold working fluid which is conducted in an open loop from a low temperature storage tank, through a succession of engine stages each comprising a constant volume heat exchanger and an expansion engine, and finally exhausted; and a secondary hot fluid which is circulated in a closed loop through successive engine stages and a secondary loop heat exchanger. A plurality of optional preliminary heat exchangers in the primary fluid loop initially heat the primary working fluid before entering the first engine stage to a temperature above the freezing temperature of the secondary fluid to eliminate freezing thereof. A secondary fluid heat exchanger enables transfer of heat between ambient tertiary fluid and the secondary fluid. Each engine stage employs a constant volume heat exchanger which provides an improved thermodynamic cycle with resulting high efficiency.

37 Claims, 9 Drawing Figures

THERMODYNAMIC ENGINE SYSTEM AND METHOD

BACKGROUND OF THE INVENTION

1. Field of the Invention

This invention relates to thermodynamic engine systems for generating the mechanical power for diverse utilization devices. More particularly, this invention relates to thermodynamic engine systems which utilize the temperature differential between two fluids to provide mechanical energy to follow-on machinery.

2. Description of the Prior Art

Thermodynamic engine systems are known in which mechanical or other forms of energy are obtained from the thermal differential between a primary working fluid and a secondary fluid, the latter typically comprising ambient air. In a typical system of this type, rotary mechanical power is obtained from the temperature differential between a primary working fluid such as nitrogen stored at cryogenic temperatures and ambient air by conducting the stored primary fluid through successive energy conversion stages in each of which the thermal-potential energy is converted into rotary mechanical energy. This rotary mechanical energy is then used directly to power a utilization device, such as a pump. Alternatively, the rotary mechanical energy may be converted in a known way to reciprocating mechanical energy for driving suitable follow-on devices.

Each engine stage in such a thermodynamic engine system typically comprises a heat exchanger in which the primary working fluid is heated at constant pressure to approximately ambient temperature and an expansion engine in which the heated fluid from the outlet of the associated heat exchanger is permitted to expand to produce mechanical energy.

Thermodynamic engine systems of this type operate with little or no noise pollution and, since the only exhaust product is an inert gas such as nitrogen, contribute no chemical pollution to the ambient atmosphere, and are thus highly desirable from an ecological standpoint. However, while some engines have been found suitable for limited applications, in general known engine systems of this type suffer from the disadvantage of being relatively inefficient.

One factor contributing to the relative inefficiency of known thermodynamic engine systems is the accumulation of ice on the heat exchangers. As the working fluid is heated and passed through each of the heat exchangers, the ambient air circulating past the external heat exchanger surfaces is cooled accordingly, causing the moisture in the air to freeze. As this moisture freezes, ice forms on the exchanger external surfaces. The resulting accumulation of ice impairs the thermal transfer efficiency of the heat exchangers, which decreases the overall efficiency of the thermodynamic engine system accordingly. With prolonged operation, this ice accumulation ultimately renders the system completely inoperative.

Attempts have been made to allieviate the problem of heat exchanger ice accumulation. For example, in copending patent application Ser. No. 182,994, filed Sept. 23, 1971 for "Nitrogen Vapor Engine" now U.S. Pat. No. 3,786,631 issued Jan. 24, 1974, a thermodynamic engine system is disclosed in which ice accumulation on the thermal transfer surfaces of each engine stage heat exchanger is minimized by means of a mechanical arrangement for abrading ice formed thereon. While this arrangement has proven satisfactory for some applications, it suffers from the disadvantage of requiring substantial amounts of mechanical energy to operate, which energy must be obtained from the available mechanical energy supplied by the expansion engine. Diversion of any amount of mechanical energy available at the output of this system is, of course, undesirable since the next available power is reduced accordingly.

In addition to the ice accumulation problem, other facts are known which contribute to the relative inefficiency of known thermodynamic engine systems. An important one of such factors is the constant pressure heat exchange portion of the thermodynamic cycle typically employed in known systems. When the working fluid is cycled along a given isobar in passing through a constant pressure heat exchanger, the entropy of the fluid irreversibly increases at a substantial rate. This irreversible increase reduces the total number of effective fluid work cycles which can be performed before the working fluid is exhausted. Since known systems typically embody several constant pressure heat exchangers, the total number of effective work cycles is severely reduced. Attempts to solve this problem have not met with wide success.

SUMMARY OF THE INVENTION

The invention comprises a thermodynamic engine system having a thermodynamic working fluid cycle in which heat exchange to the working fluid is performed at constant volume, which is highly efficient and pollution free, and which eliminates the problem of heat exchanger icing. The invention employs a primary cold working fluid which is conducted in an open loop from a low temperature storage tank, through a succession of engine stages each comprising a constant volume heat exchanger and expansion engine, and ultimately exhausted; and a secondary hot fluid which is circulated in a closed loop through the successive engine stages and a secondary loop heat exchanger. The primary fluid loop is optionally provided with a plurality of preliminary heat exchangers for initially heating the primary working fluid to a temperature above the freezing temperature of the secondary fluid before the first heat exchanger stage is encountered by the primary working fluid. This optional arrangement ensures that the secondary fluid never freezes in the engine stage heat exchangers. A single secondary fluid heat exchanger is provided for injecting heat into the secondary fluid. De-icing means is provided, if required, for preventing icing of this heat exchanger.

Several embodiments of engine stages are provided. In each of the embodiments, the primary working fluid is passed through a constant volume heat exchanger having a constant volume region which is separated by a thermal transfer wall from the secondary fluid circulating in the closed secondary fluid loop. The constant volume heating provided by the heat exchangers provides an extremely efficient thermodynamic cycle for the primary working fluid. After heating, the primary working fluid is conducted to an expansion engine portion in which the heated primary fluid is permitted to expand to produce mechanical energy. In a first embodiment, the heat exchangers and expansion engines are mounted on separate rotatable shafts, each shaft serving to serially connect all common portions, (i.e. all heat exchangers and all expansion engines), respectively. In a second embodiment, each expansion engine portion of an engine stage is flanked by a pair of constant volume heat exchangers, with all units mounted on a common output shaft. In still another embodiment, each heat exchanger and expansion engine is combined as a single unit substantially concentric of a single work shaft, with the heat exchanger portion occupying approximately one half of the housing geometry and the expansion engine portion occupying the remaining portion of the housing geometry.

A starting mechanism is incorporated for providing automatic starting of the engine on demand. In the preferred embodiment, this mechanism comprises a pressure chamber for receiving a quantity of primary working fluid and storing the same under pressure via an inlet valve, and for coupling the stored pressurized primary working fluid to the primary fluid line via an outlet valve. The outlet valve may be either manually or remotely operative.

For a further understanding of the nature and advantages of the invention, reference should be had to the following detailed description taken in conjunction with the accompanying drawings.

DESCRIPTION OF THE PREFERRED EMBODIMENT

Figure 1:
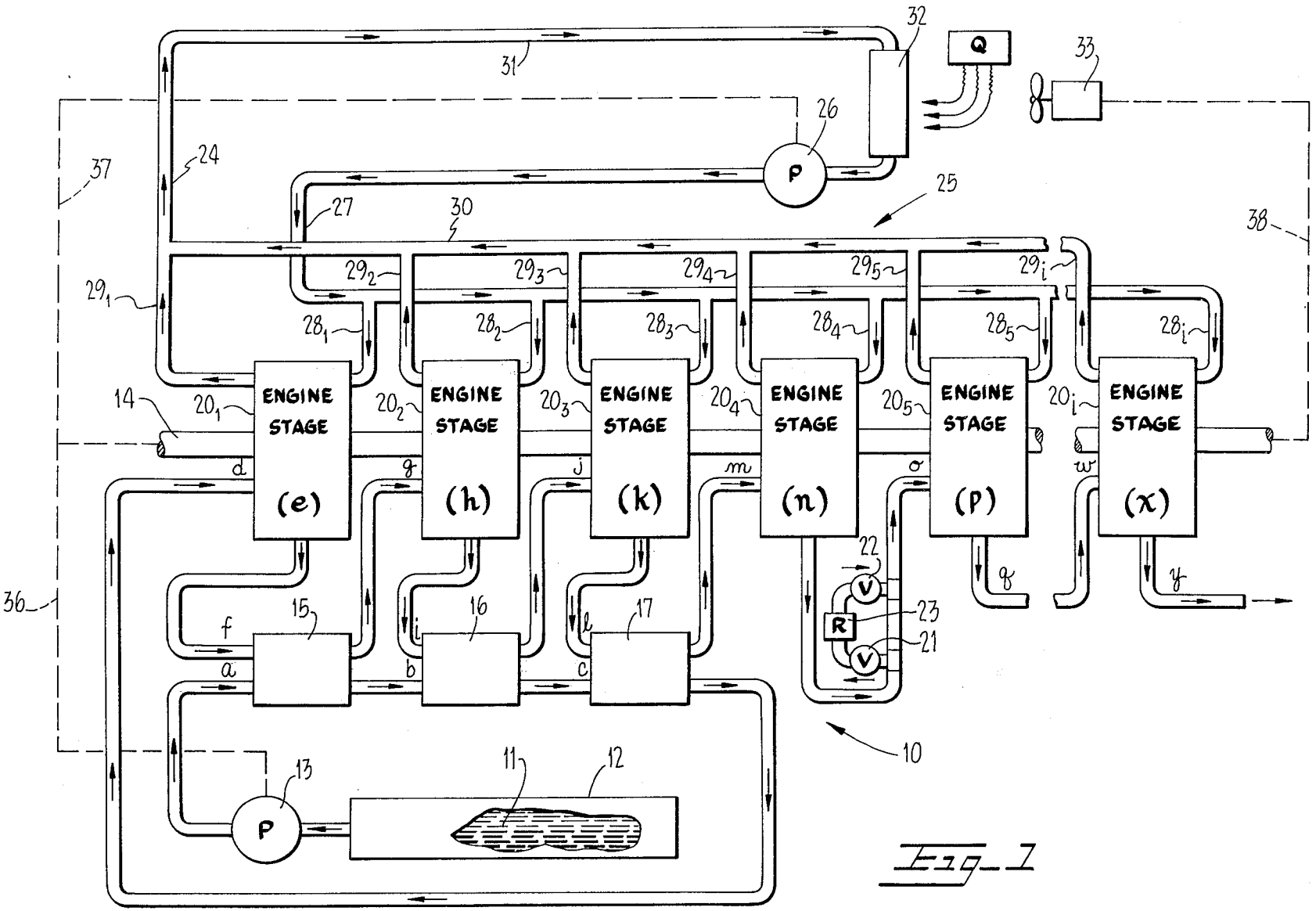
FIG. 1 is a schematic diagram of the system of the invention.

Turning now to the drawings, FIG. 1 illustrates a thermodynamic engine system in accordance with the invention and having an open primary fluid loop indicated generally at 10 and a closed secondary fluid loop indicated generally at 25. Primary working fluid 11, which in the preferred embodiment comprises liquid nitrogen, is stored at cryogenic temperature in an insulated tank 12. The primary working fluid 11 is fed from storage tank 12 by means of a feeder pump 13 powered by a main work shaft 14 described below to the first of a series of three heat exchangers 15–17. Heat exchangers 15–17 are conventional constant pressure heat exchangers and operate to raise the temperature of primary working fluid 11 above the freezing temperature of the fluid in secondary fluid loop 25.

After passing through heat exchanger 17, the primary working fluid 11 is conducted to the inlet of a first one of a plurality of engine stages $\mathbf{20}_1 - \mathbf{20}_i$. As described more fully below, each engine stage comprises a constant volume heat exchanger and an expansion engine. The primary working fluid 11 is conducted from the output of engine stage $\mathbf{20}_1$ through constant pressure heat exchanger 15 to the inlet of engine stage $\mathbf{20}_2$. After passing through engine stage $\mathbf{20}_2$, primary working fluid 11 is coupled from the outlet thereof through constant pressure heat exchanger 16 to the inlet of engine stage $\mathbf{20}_3$. After passing through engine stage $\mathbf{20}_3$, primary working fluid 11 is coupled from the outlet thereof through constant pressure heat exchanger 17 to the inlet of engine stage $\mathbf{20}_4$.

As will now be evident, the downstream primary working fluid, which is hotter than the primary working fluid in the region between tank 12 and the outlet of pump 13, thus serves as a heat source for heating the upstream primary working fluid in heat exchangers 15–17. It is noted that, while three constant pressure heat exchangers 15–17 are utilized in the preferred embodiment of FIG. 1, a greater or smaller number of heat exchangers may be employed depending on the particular requirements on a given application. In many applications, e.g., the maximum temperature differential between primary working fluid 11 and secondary fluid 12 is insufficient to cause a freezing problem, even though the initial temperature of primary working fluid 11 lies below the freezing point of secondary fluid 12. In such applications heat exchangers 15–17 may be entirely omitted and primary working fluid 11 may be coupled directly from tank 12 to the inlet of engine stage $\mathbf{20}_1$.

Downstream of heat exchanger 17, the primary working fluid 11 is coupled through the remaining engine stages $\mathbf{20}_4$–$\mathbf{20}_i$ in serial fashion. The exact number $i$ of engine stages $\mathbf{20}_i$ is dependent upon the particular requirements of any given application. The primary fluid 11 is lastly exhausted from ultimate engine stage $\mathbf{20}_i$. Depending upon the particular application, the exhausted primary working fluid may be vented to atmosphere or conducted to some other environment. When used in conjunction with electronic devices in a marine environment, e.g., the exhausted fluid may be used to provide an inert atmosphere for protecting the electronic equipment from sea water. Other suitable arrangements and uses for exhausted primary working fluid will occur to those skilled in the art.

An automatic starting device has an inlet valve 21 and an outlet valve 22 each coupled at one end to primary fluid loop 10 between appropriate engine stages and at the other end to a fluid reservoir 23. Fluid reservoir 23 stores primary working fluid under pressure via inlet valve 21 when the engine system is operating, and releases the stored primary fluid in response to the actuation of outlet valve 22 to provide an initial starting surge when it is desired to start the engine system. Valves 21, 22 may comprise any one of a number of known valve devices, depending on the requirements of a particular application. For example, if the invention is used as a remotely located power generator, valve 21 may be an inlet check valve which opens after the primary working fluid at the inlet thereto attains a predetermined pressure, while valve 22 may be a normally closed automatic valve responsive to the generation of a control signal from a distant control station to open and couple the previously stored pressurized fluid in reservoir 23 to the inlet of succeeding engine stage $\mathbf{20}_5$.

Although depicted as coupled between engine stage $\mathbf{20}_4$ and the following engine stage $\mathbf{20}_5$, it is understood that the automatic starting device may be coupled to primary fluid loop 10 at any suitable portion thereof. Further, other engine starter devices may be employed as desired. For example, a battery driven electrical motor may be coupled to main work shaft 14 by appropriate known coupling means for starting purposes in applications where electrical power is available when the system is not operating. Other arrangements will occur to those skilled in the art.

The secondary fluid 24 is circulated through closed secondary fluid loop 25 by means of a conventional circulation pump 26, a conduit 27, and a plurality of parallel connected inlet conduits $28_1 - 28_i$ to the secondary fluid inlet of each of engine stages $20_1 - 20_i$. After passing through respective engine stages $20_1 - 20_i$, the cooled secondary fluid 24 is coupled via a plurality of parallel connected outlet conduits $29_1 - 29_i$ and common conduits 30, 31 to a single heat exchanger 32.

Heat exchanger 32 is a conventional unit for injecting heat from a source indicated generally at Q into the secondary fluid. THe heat source may comprise ambient air, a body of water, the earth, or the like depending on a given application. A suitable circulation means, such as fan 33 may be provided if necessary for directing the heat from source Q to heat exchanger 32. After passage through heat exchanger 32, the secondary fluid 24 is recycled through the secondary fluid loop by pump 26. In some applications the temperature of the heat source Q may be so low as to render possible icing of secondary heat exchanger 32. Such a possibility might arise, e.g., if heat source Q comprised ambient air at a temperature below 32° F. In such applications, icing of secondary heat exchanger 32 may be prevented by conventional means, such as by injecting a de-icing fluid upstream therefrom or by providing a pair of alternately operated secondary fluid heat exchangers each having a duty cycle of approximately 50%.

Although many fluids are suitable for use as the secondary fluid 24, the preferred fluid is ASHRAE. (American Society of Heating, Refrigeration and Air Conditioning Engineers) No. 216 Refrigerant (1,3 - dichlorohexafluoropropane ($C_3 Cl_2 F_6$). The following refrigerants are also suitable for this purpose:

| ASHRAE NO. | CHEMICAL FORMULA | COMPOUND |
|---|---|---|
| Refrigerant 11* | $C Cl_3 F$ | Trichlorofluoroethane |
| Refrigerant 12 | $C Cl_2 F_2$ | Dichlorodifluoromethane |
| Refrigerant 13 | $C Cl F_3$ | Chlorotrifluoromethane |
| Refrigerant 717 | $NH_3$ | Anhydrous Ammonia |
| Refrigerant 142 b | $CH_3CCl F_2$ | Trichlorofluoromethane |
| Refrigerant 152 a | $CH_3CH F_2$ | Difluoroethane |
| Refrigerant 216 | $C_3Cl_2 F_6$ | 1,3 Dichlorohexafluoro-propane |
| Refrigerant 290 | $CH_3CH_2CH_3$ | Propane |
| Refrigerant 600 | $CH_3CH_2CH_2CH_3$ | N-Butane |
| Refrigerant 600a | $CH (CH_3) 3$ | Isobutane |
| Other suitable fluids will occur to those skilled in the art. | | |

Figure 2:
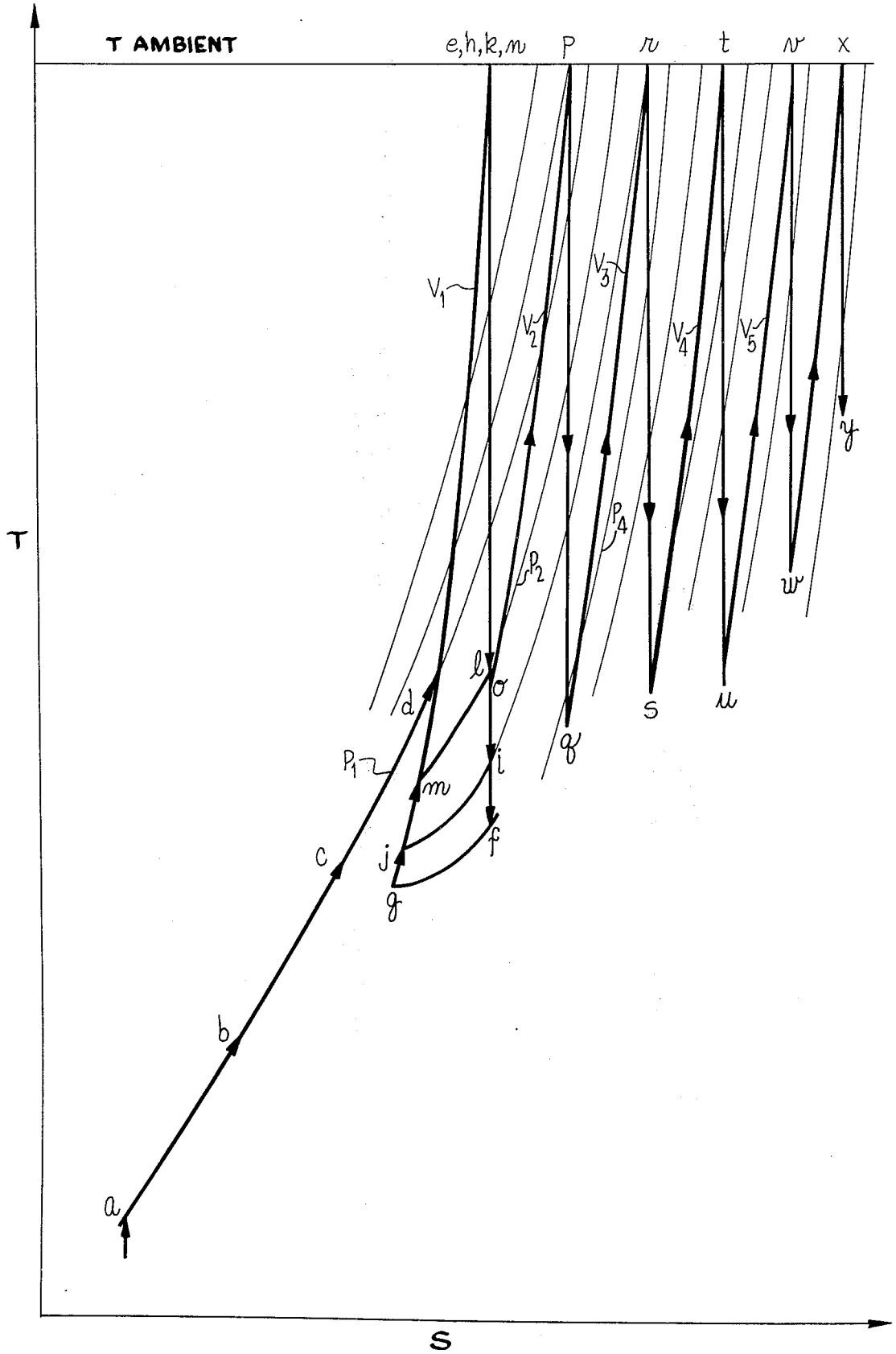
FIG. 2 is a T-S chart illustrating the operation of the system of FIG. 1.

The operation of the system of FIG. 1 may best be understood with reference to FIGS. 1 and 2, the latter comprising a temperature-entropy, or T-S, chart for the primary working, fluid 11 of the system of FIG. 1. In the FIG. 2 T-S chart, curves $P_c$ depict isobars or curves of constant pressure, while curves $V_2$ depict curves of constant volume for the fluid.

As the primary working fluid is pumped from source tank 12 to the inlet of constant pressure heat exchanger 15, it is substantially isentropically compressed to state *a*. As the primary working fluid passes through constant pressure heat exchanger 15 it is isobarically heated from state *a* to state *b* by the fluid expelled from first engine stage $20_1$ downstream therefrom. The primary working fluid is next passed through constant pressure heat exchanger 16, where it is isobarically heated from state *b* to state *c*, and through constant pressure heat exchanger 17, where it is again isobarically heated from state *c* to state *d*. After exiting from constant pressure heat exchanger 17, the temperature of primary working fluid 11 is above the freezing temperature of the secondary fluid in secondary fluid loop 25.

As primary working fluid 11 passes through the constant volume heat exchanger portion of engine stage $20_1$ it is heated at constant volume to state *e*. After reaching state *e*, the fluid passes through the expansion engine portion of stage $20_1$ where it is substantially isentropically expanded to state *f*, thereby producing mechanical energy. The expansion efficiency defined herein as the quotient of the actual enthalpy change and the enthalpy change, for an isentropic process, is approximately 0.90 for this and all subsequent expansion portions of the thermodynamic cycle. After being substantially isentropically expanded to state *f*, the primary fluid passes through constant pressure heat exchanger 15 wherein it is isobarically cooled from state *f* to state *g*. Upon entering second engine stage $20_2$ the primary fluid is first heated at constant pressure from state *g* to state *h* and subsequently substantially isentropically expanded to state *h* to state *i*. From the outlet of second stage $20_2$, the primary fluid is isobarically cooled from state *i* to state *j* in constant pressure heat exchanger 16. The primary fluid is then passed through engine stage $20_3$ where it is first heated at constant volume from state *j* to state *k* and subsequently substantially isentropically expanded to state *l*. The primary fluid is next passed through engine stage $20_4$ wherein it is heated at constant volume from state *m* to state *n* and subsequently expanded substantially isentropically to state *o*.

Primary fluid from the outlet of stage $20_4$ is then serially passed through the succeeding engine stages $20_5 - 20_i$ wherein alternate constant volume heating and substantially isentropic expansion steps occur, such as from state *o* to state *p* and from state *p* to state *q*, respectively. Upon exiting from the last engine state **20*i***, the primary working fluid at state *y* is either exhausted to ambient or is utilized in the manner noted above.

As noted above, the constant pressure heating of primary working fluid 11 provided by heat exchangers 15–17 initially raises the temperature of primary working fluid 11 above the freezing temperature of the secondary fluid in secondary fluid loop 25. This eliminates the possibility of the secondary fluid 24 becoming frozen in one or more of the constant volume heat exchangers in engine states $20_1 - 20_i$. In addition, the initial constant pressure heating of primary working fluid 11 from state *a* to state *d* enables the primary working fluid 11 to achieve the same high state *e*, *h*, *k*, *n* during the first four constant volume heating steps, thereby improving the overall efficiency of the thermodynamic engine system. As also noted above, however, in many applications heat exchangers 15–17 are unnecessary. In such applications, the initial portion of the primary fluid T-S diagram reflects the absence of the isobaric heating provided along portions *a–d*.

Contributing primarily to the efficiency of the system are the constant volume portions of the thermodynamic cycle employed. With reference to the T-S chart of FIG. 2, the curves of constant volume $V_i$ are substantially steeper than the isobars $P_i$. Thus, as the primary working fluid 11 is heated to the maximum design temperature during each constant volume heating portion of the cycle, the increase in entropy which the fluid undergoes is substantially less than that which would be experienced by the same fluid undergoing a constant pressure heating to the same maximum design temperature. Accordingly, the primary working fluid 11 can undergo a number of work cycles before attaining an entropic state at which the fluid is no longer effective which is correspondingly greater than the number of cycles obtainable with a system employing a thermodynamic cycle using constant pressure heating. Since the number of possible re-heat cycles is greater, the number of possible engine stages is also greater, and correspondingly, the total amount of useful work obtainable from the system is also greater than comparable systems using constant pressure heating. Systems employing constant volume heating according to the invention are thus capable of performing a greater amount of useful work per pound of primary working fluid 11 than systems which employ constant pressure re-heat cycles, and accordingly have a greater practical efficiency.

Mechanical energy is obtained during the substantially isentropic expansion portions of the primary working fluid thermodynamic cycle in the form of rotation of common work shaft 14 schematically depicted in FIG. 1. A portion of this mechanical energy is used to power heater pump 13, secondary fluid circulation pump 26, and fan 33. This may be accomplished by conventionally mechanical devices which are accordingly not depicted in detail but schematically indicated by broken lines 36–38.

Figure 3:
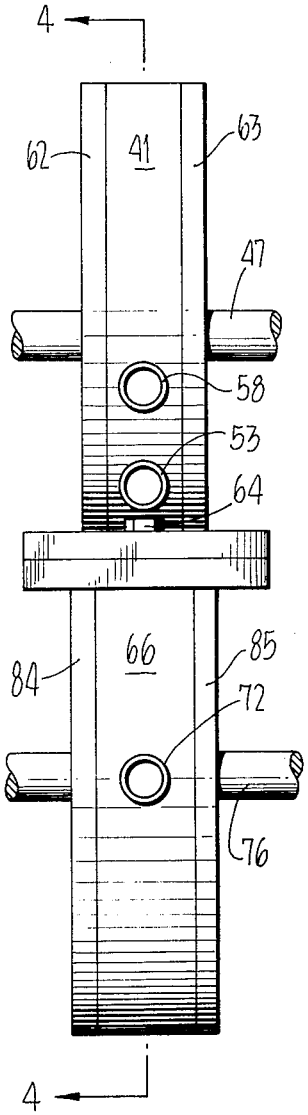
FIGS. 3–4 illustrate a first embodiment of an engine stage.
Figure 4:
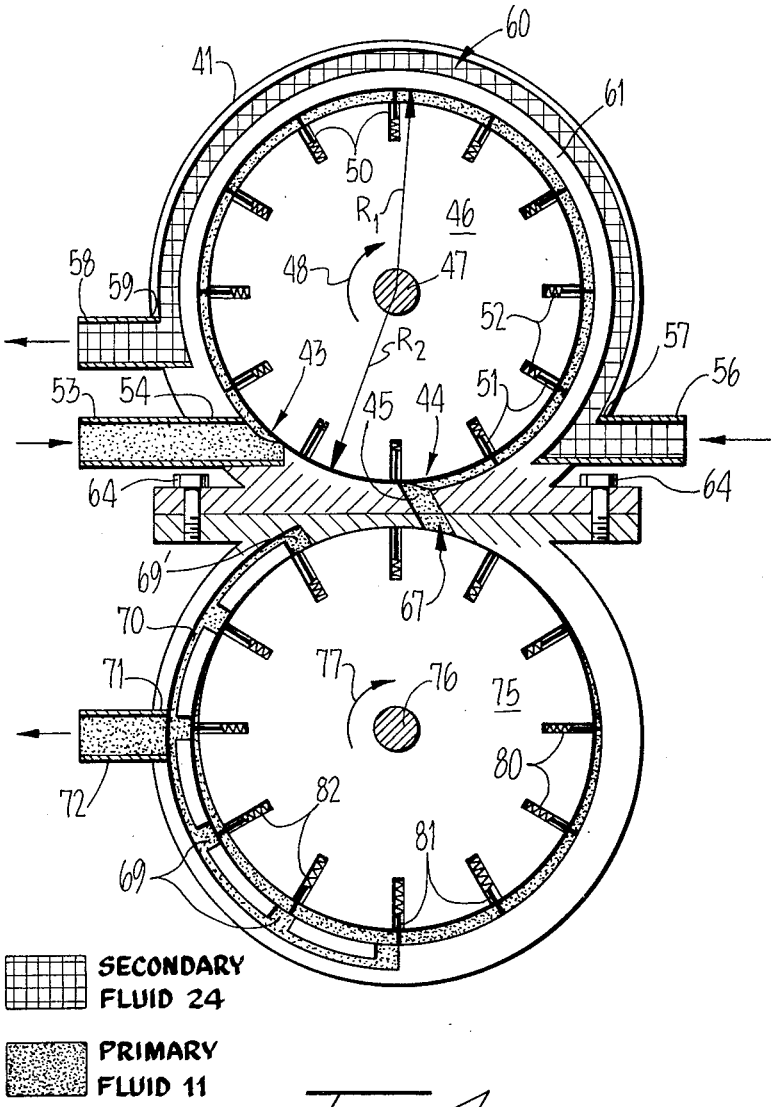

FIG. 3 is a front view and FIg. 4 is a sectional view taken along lines 4—4 of FIG. 3 of a first embodiment of an engine stage suitable for use in the thermodynamic engine system of the invention. The constant volume heat exchanger portion comprises the upper half of the embodiment shown in FIG. 4 and includes an outer partially cylindrical central housing 41 having a hollow interior. The inner-wall surface of central housing 41 comprises a first angular portion having a radius $R_1$ extending from a primary fluid inlet portion 43 in a clockwise direction to a primary fluid outlet portion 44, and a second smaller arcuate portion having a constant radius $R_2$ smaller in magnitude than radius $R_1$ extending from outlet portion 44 in a clockwise direction to inlet portion 43. A pair of smoothly contoured ramps connect the $R_1$, $R_2$ wall portions as shown. Positoned within the hollow interior of central housing member 41 is a cylindrical rotor 46 secured to a drive shaft 27 for rotation in the direction of arrow 48. Rotor 46 has a circular crosssection of radius slightly smaller than $R_2$. The circumference of rotor 46 is provided with a plurality of radially directed longitudinally extending slots 50 equi-angularly spaced circumferentially thereabout. Even slot 50 is provided with a sliding vane 51 biased radially outwardly by a biasing member 52 such as a spring or the like.

A primary working fluid inlet fitting 53 is sealingly secured in a first inlet port 54 in central housing 41 terminating in inlet portion 43. A secondary fluid inlet fitting 56 is sealingly secured to a second inlet port 57 provided in central housing 41. A secondary fluid outlet fitting 58 is sealingly secured in a secondary fluid outlet port 59 provided in central housing 41 above primary fluid inlet port 54. A primary fluid outlet port 45 is formed in the bottom portion of central housing 41 to provide fluid communication between outlet portion 44 and an inlet port of the expansion engine portion described below. Secondary fluid inlet and outlet fittings 56, 58 communicate with a secondary fluid passage 60 formed internally of central housing 41. The wall portion 61 between secondary fluid passage 60 and the interior of central housing 41 define a thermal transfer region through which heat may be transferred from secondary fluid 24 to primary fluid 11.

A pair of end plates 62,63 are sealingly secured to the end portions of central housing 41 to seal the interior thereof. Suitable bearing means are provided (not shown) to permit rotation of driven shaft 47 and rotor 46 secured thereto.

The upper constant volume heat exchanger portion is secured by means of cap screws 64 to a lower expansion engine portion which includes a central housing generally cylindrical hollow housing 66. Central housing 66 is provided with a primary fluid inlet port 67 designed to mate with primary fluid outlet port 45 from the constant volume heat exchanger portion. Inlet port 67 communicates with the generally cylindrical hollow interior of central housing 66. The interior of central housing 66 is provided at the outlet side with a plurality of primary fluid exhaust ports 69 coupled via a manifold 70 to an outlet port 71. An outlet fitting 72 is sealingly secured in outlet port 71.

Mounted eccentrically within the interior of central housing 66 is a substantially cylindrical rotor 75 secured to an output shaft 76 for rotation in the direction of arrow 77. The eccentricity of the position of rotor 75 is selected to provide substantially no clearance between the outer surface or rotor 75 and the inner surface of central housing 66 in the region between the last encountered exhaust port 69' and inlet port 67.

A plurality of longitudinally extending slots 80 are arranged equi-angularly about the circumference of rotor 75. Each slot 80 is provided with a sliding vane 81 biased radially outwardly by a biasing member 81 such as a spring or the like.

A pair of end plates 84, 85 are sealingly secured to the end portions of central housing 66 to seal the interior thereof. Suitable bearing means are provided (not shown) to permit rotation of output shaft 76 and rotor 75 secured thereto.

In practice, a plurality of heat exchanger portions and expansion engine portions are mounted in a row, with the heat exchanger rotors 46 commonly coupled to driven shaft 47 and the expansion engine rotors 75 commonly coupled to output shaft 76.

In operation, rotation of rotor 75 and output shaft 76 is coupled to drive shaft 47 by suitable coupling apparatus e.g. a pair of pulleys and a drive belt (not shown), thereby rotating heat exchange rotor 46. As each vane 51 is swept into the primary fluid inlet region 43, it is extended by biasing means 52 until it contacts the inner wall surface of central housing 41. As rotor 43 continues to rotate each vane 51 sweeps along this inner wall surface providing a fluid seal therewith. Upon reaching outlet region 48, vane 51 is forced radially inwardly by the decreasing radius of the inner wall surface, passes along the portion of maximum retraction between outlet region 48 and inlet region 47, and then repeats this cycle. Since the annular volume measured in a clockwise direction from inlet region 47 to outlet region 48 defined by the radii $R_1$, $R_2$ is constant, incoming primary working fluid 11 introduced via inlet fitting 53 encounters a constant volume region throughout the interior of central housing 41. Secondary fluid 24 passes counterflow to the primary working fluid 11 from inlet fitting 56 via internal passage 60 to outlet fitting 58. As the two fluids counterflow through the heat exchanger portion, heat is transferred through the wall portion 61 from the secondary fluid to the primary fluid.

Heated primary fluid exiting from the constant volume heat exchanger portion enters the expansion engine portion via inlet port 67. As the primary fluid progresses along the volume between the outer surface of rotor 75 and the inner surface of central housing 66 it encounters an expanding volume until the first exhaust port 69 is encountered. The expansion of the primary working fluid in this region acts on the surface of extended vanes 81 to provide a net force in the clockwise direction, thereby rotating rotor 75 and output shaft 76. The expanded primary working fluid is collected by exhaust ports 69 and manifold passage 70 and exhausted via outlet fitting 72.

Figure 5:
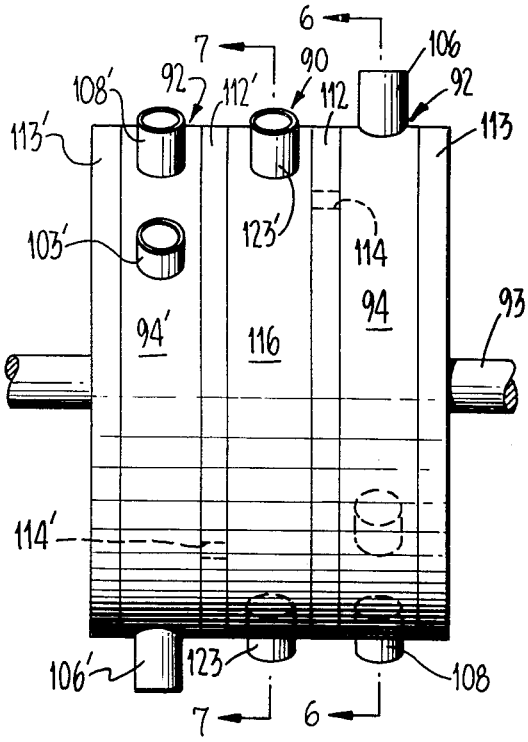
FIGS. 5–7 illustrate a second embodiment of an engine stage.
Figure 6:
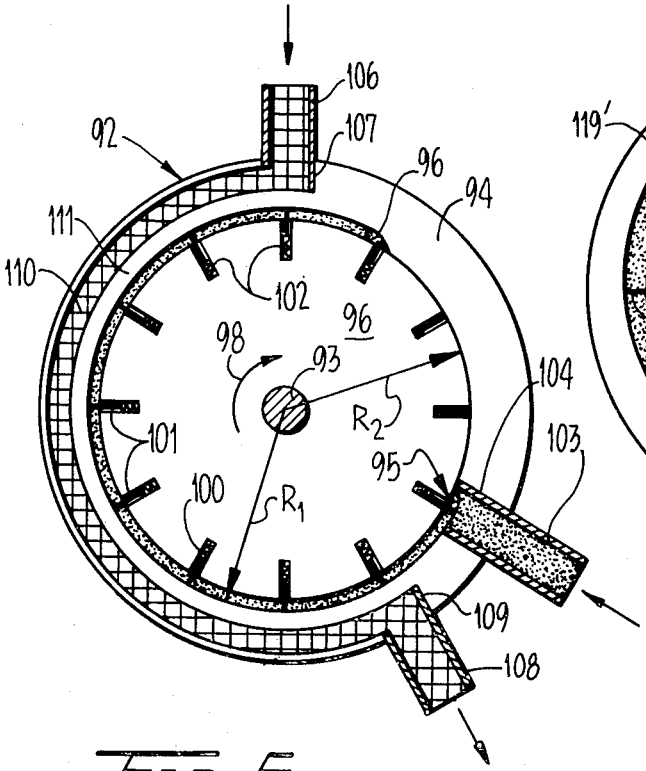
Figure 7:
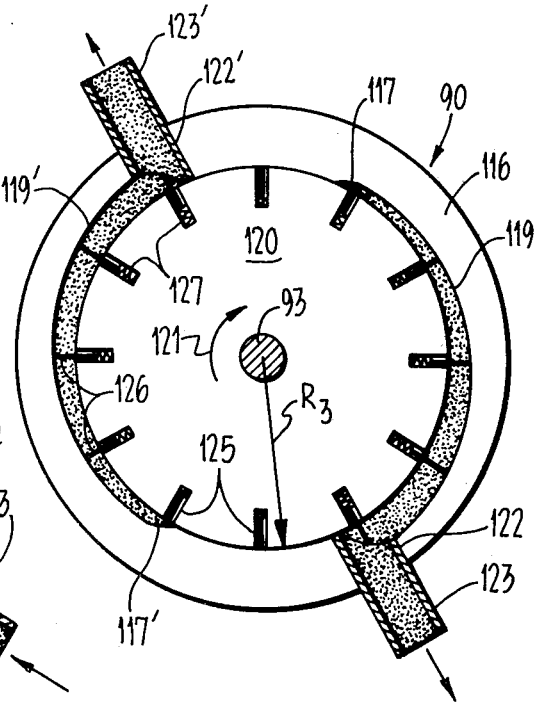

FIG. 5 is a front elevational view and FIGS. 6 and 7 are sectional views taken along lines 6—6 and 7—7, respectively, of FIG. 5 of a second embodiment of an engine stage suitable for use in the thermodynamic engine system of the invention. In this embodiment, each engine stage $20_i$ comprises a central expansion engine portion 90 flanked by a pair of similar heat exchanger portions 92, 92'. Expansion engine portion 90 and heat exchanger portions 92, 92' are mounted on a common shaft 93 with heat exchanger portion 92' angularly displaced from heat exchanger portion 92 by 182°.

As best shown in FIG. 6, which depicts heat exchanger portion 92, each heat exchanger portion 92, 92' is configured in a substantially similar manner to the heat exchanger portion shown in FIGS. 3 and 4. A cylindrical central housing 94 has a hollow interior with a first angular wall surface portion having a radius $R_1$ extending clockwise from a primary fluid inlet portion 95 to a primary fluid outlet region 96, and a second smaller arcuate wall surface portion having a constant radius $R_2$ smaller in magnitude than radius $R_1$ extending clockwise from primary fluid outlet region 96 to primary fluid inlet portion 95. Positioned within the hollow interior of central housing member 94 is a cylindrical rotor 96 secured to common shaft 93 for rotation in the clockwise direction indicated by arrow 98 and having a circular cross section or radius slightly smaller than $R_2$ in order to provide a close fit between the outer surface thereof and the second smaller arcuate wall surface portion of housing 94. The circumference of rotor 96 is provided with a plurality of radially directed longitudinally extending slots 100 equi-angularly spaced circumferentially thereabout. Each slot 100 is provided with a sliding vane 101 biased radially outwardly by a suitable biasing means 102.

A primary working fluid inlet fitting 103 is sealingly secured in a first inlet port 104 in central housing 94 terminating in inlet portion 95. A secondary fluid inlet fitting 106 is sealingly secured to a second inlet port 107 provided in central housing 94. A secondary fluid outlet fitting 108 is sealingly secured in a secondary fluid outlet port 109 provided in central housing 94 adjacent primary fluid inlet port 104. Secondary fluid inlet and outlet fittings 106,108 communicate with a secondary fluid passage 110 formed internally of central housing 94. The wall portion 111 between secondary fluid passage 110 and the interior of central housing 94 defines a thermal transfer region through which heat may be transferred from secondary fluid 24 to primary fluid 11.

A pair of end plates, 112, 113 are sealingly secured to the end portions of central housing 94 to seal the interior thereof. Suitable bearing means are provided (not shown) to permit rotation of common shaft 93 and rotor 96 secured thereto.

As noted above, heat exchanger portion 92' is substantially identical to heat exchanger portion 92. Accordingly, in the ensuing description, the elements of heat exchanger portion 92' which are identical to elements of heat exchanger portion 92 are designated by primed reference numerals. As further noted, above, heat exchanger portion 92' is mounted in an angular position which is rotated 180° from the axial position of heat exchanger 92. In addition, end plates 112, 112' are each provided with a bore 114, 114' shown by FIG. 5 by broken lines, respectively, for providing fluid communication for working fluid contained therein from the primary fluid outlet region 96, 96' to a pair of primary fluid inlet regions in centrally located expansion engine portion 90 described below.

As best seen in FIG. 7, expansion engine portion 90 comprises a cylindrical central hollow housing 116 provided with a pair of primary fluid inlet regions 117, 117' designed to align with fluid bores 114, 114' in end plates 112, 112', respectively. Each inlet region 117, 117' communicates with a different one of a pair of variable volume regions defined by first and second wall surface portions 119, 119' of central housing 116 and the circumference of a substantially cylindrical rotor 120 concentrically mounted within central housing 116 and secured to output shaft 93 for rotation in the clockwise direction indicated by arrow 121. Variable volume regions 119, 119' each terminate at a different outlet port 122, 122'. A pair of primary fluid outlet fittings 123, 123' are sealingly secured in outlet ports 122, 122' respectively. Central housing 116 is provided with third and fourth wall surface portions between outlet port 122' and inlet region 117, and outlet port 122 and inlet region 117' respectively of substantially constant radius $R_3$.

Expansion engine portion rotor 120 of radius slightly smaller than $R_3$ is provided with a plurality of slots 125, sliding vanes 126, and biasing means 127 in a manner and for a purpose substantially similar to that described above.

In practice, a plurality of engine stages, each comprising an expansion engine portion 90 flanked by heat exchanger portion 92, 92' are mounted along common shaft 93 with the number of stages depending upon the particular application requirements.

Operation of the embodiment shown in FIGS. 5–7 proceeds in a similar fashion to that described above with reference to FIGS. 3 and 4. Thus, primary working fluid 11 enters heat exchanger portions 92 and 92' via inlet fittings 103, 103' and passes through the constant volume region where it is heated at constant volume by the transfer of heat through wall portions 111, 111' from secondary fluid 24 counterflowing via inlet fittings 106, 106', secondary fluid passages 110, 110' and secondary fluid outlet fittings 108, 108'. Heated primary fluid 11 is coupled from primary fluid outlet regions 96, 96' via outlet bores 114, 114' to inlet regions 117, 117' of the expansion engine portion 90. The heated primary fluid 11 expands along the variable volume regions, thereby rotating rotor 120 and common shaft 93. The expanded primary working fluid 11 is exhausted via outlet fittings 123, 123'.

Though similar in operation to the embodiment of FIGS. 3 and 4, the embodiment shown in FIGS. 5–7 offers the advantage of requiring only a single output shaft 93 to which all heat exchanger portions and expansion portions are coupled. In addition, this embodiment offers the further advantage of providing a greater capability of transferring heat from the secondary fluid 24 to the primary working fluid 11 due to the use of two heat exchanger portions for each expansion engine portion. Moreover, the provision of two variable volume regions in expansion engine portion 90 enables a greater amount of torque to be produced by a single engine stage than the embodiment of FIGS. 3 and 4.

Figure 8:
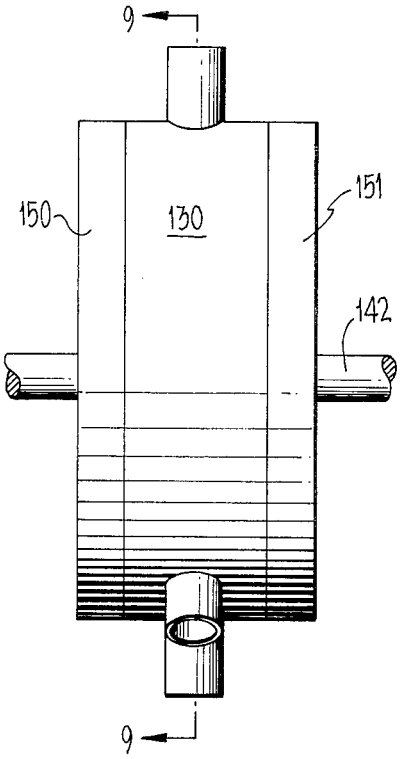
FIGS. 8–9 illustrate a third embodiment of an engine stage.
Figure 9:
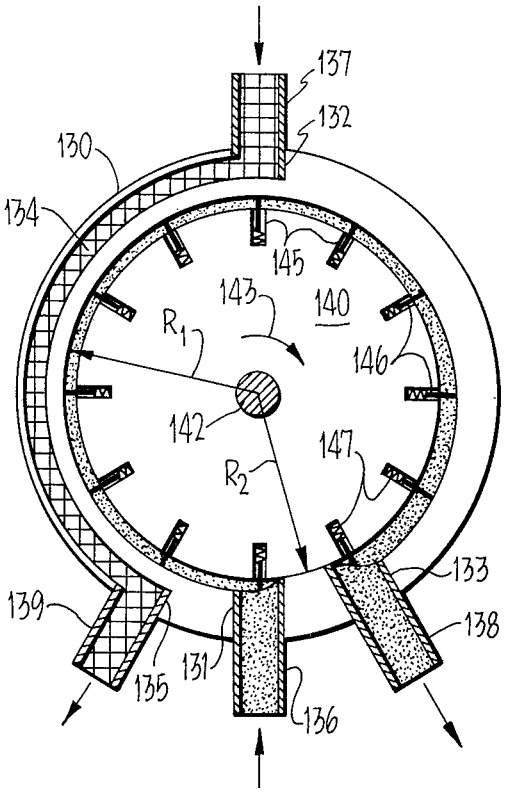

FIG. 8 is a front elevational view and FIG. 9 is a sectional view taken along lines 9—9 of FIG. 8 of another embodiment of an engine stage suitable for use in the thermodynamic engine system of the invention. In this embodiment, each engine stage 20 comprises a single unit incorporating both the heat exchanger portion and the expansion engine portion in a single housing 130. Housing 130 has a hollow interior with a first wall surface portion having a constant radius $R_1$ in the region extending clockwise from a primary fluid inlet port 131 to an intermediate angular location adjacent a secondary fluid inlet port 132, and a second wall surface portion of increasing radius in the region extending in a clockwise direction from the intermediate angular location adjacent secondary fluid inlet port 132 to a primary fluid outlet port 133. A third wall surface portion in the region between inlet port 131 and outlet port 132 is substantially cylindrical of radius $R_2$ smaller than $R_1$. A secondary fluid passage 134 is formed in central housing 130 and extends between secondary fluid inlet port 132 and a secondary fluid outlet port 135. Ports 131, 132, 133 and 135 are each provided with suitable fittings 136–139 seaingly secured thereto.

A single substantially cylindrical rotor 140 having a radius slightly smaller than $R_2$ is mounted on a common shaft 142 within central housing 130 concentrically with respect to radius $R_1$ for rotation in the clockwise direction indicated by the arrow 143. Rotor 140 is provided with the usual circumferentially arranged slots 145, sliding vanes 146 and biasing means 147, in the manner and for the purpose described above.

A pair of end plates 150, 151 are sealingly secured to central housing 130 to seal the interior thereof. Suitable bearing means are provided (not shown) to permit rotation of common shaft 142 and rotor 140 secured thereto.

In operation, the primary working fluid 11 enters via inlet fitting 136 and undergoes constant volume heating for substantially the first 180° of rotor 140 movement. Thereafter, the heated primary working fluid 11 expands in the variable volume region between inlet fitting 137 and outlet fitting 133 thereby producing shaft motion.

In addition to the advantage of requiring only a single work shaft 142, the embodiment of FIGS. 8 ad 9 is extremely compact and economical to manufacture and assemble and may be preferred where physical size or ease of assembly is a primary requirement of a given application.

Systems constructed according to the invention may be used in a wide variety of applications and are particularly well suited for use in providing power in remote locations, e.g. in water-borne sonobuoys, meterological monitoring stations, weather radar stations, remote cloud seeding stations and microwave repeater stations. In addition, since no volatile fuels or hot exhaust gases are present the invention is ideally suited for applications in which noise or chemical pollution cannot be tolerated or where explosion or fire hazards exist. Moreover, the invention can be operated over a wide range of environmental temperatures without adverse effects on the efficiency thereof. Further, since the invention requires an extremely short period of the order of less than three seconds within which to come up to full operating power, systems constructed according thereto are ideally suited for use where standby power is required quickly, e.g. in hospital operating rooms.

While the foregoing provides a full disclosure of the preferred embodiments of the invention, it is understood that various modifications, alternate constructions and equivalents may be employed without departing from the true spirit and scope of the invention. For example, while the invention has been described as an open system operating at temperatures below the ambient, the gain in efficiency due to transferring heat to the working fluid at constant volume is also of benefit in engines working at any temperature and in either open systems or closed loops. More particularly, in commercial electrical generating systems and nuclear powered stations heat may be transferred to the working fluid either directly from the hot gases of combustion or by means of a secondary fluid. In applying the invention to such stations, the conventional boilers customarily employed would be replaced by constant volume heaters and the remainder of the system altered to match the output of these devices. The result of these changes would be a reduction in fuel use for the same power generation. In addition to the economic gain, thermal and atmospheric pollution would be reduced accordingly and also fuel reserves likewise conserved. By way of further example, other devices which may benefit from the utilization of constant volume heating are gas turbines, vapor cycle vehicles, Sterling engines, nuclear powered generators, solar powered engines and any other heat engine. Therefore, the above description and illustrations should not be construed as limiting the scope of the invention which is defined by the appended claims.

What is claimed is:

1. A thermodynamic engine system for providing mechanical energy from thermal-potential energy comprising:

a primary working fluid loop adapted to be coupled to a source of primary working fluid stored at a cold temperature;

a secondary fluid loop adapted to be coupled to a source of secondary fluid stored at a second temperature;

at least one engine stage comprising a constant volume heat exchanger means for enabling heat transfer from said secondary fluid to said primary working fluid while maintaining the volume of said primary working fluid substantially constant, said heat exchanger means having a primary working fluid loop and a primary working fluid outlet port and a pair of secondary fluid inlet and outlet ports, and an expansion engine coupled to said primary working fluid outlet port of said heat exchanger means for generating mechanical energy from heated primary working fluid coupled thereto.

2. The system of claim 1 wherein said primary working fluid loop is an open loop and said secondary fluid loop is a closed loop for containing said secondary fluid.

3. The system of claim 2 further including preliminary heat exchanger means coupled to said primary working fluid loop engine stage for initially heating said primary working fluid to a temperature above the freezing temperature of said secondary fluid.

4. The system of claim 1 wherein said primary working fluid loop includes means for pumping said primary working fluid from the inlet of said primary working fluid loop to said engine stage.

5. The system of claim 4 wherein said pumping means is powered by said engine stage.

6. The system of claim 1 further including an additional heat exchanger means coupled to said secondary fluid loop upstream from said engine stage for transferring heat from a tertiary heat source to said secondary fluid, and means for pumping said secondary fluid from said additional heat exchanger means to said secondary fluid inlet of said engine stage.

7. The system of claim 6 wherein said secondary fluid pumping means is powered by said engine stage.

8. The system of claim 1 further including engine starting means coupled to said primary working fluid loop having a reservoir for storing a quantity of said primary working fluid under pressure, and valve means for coupling said primary working fluid stored under pressure to said engine stage to provide an initial starting surge of primary working fluid.

9. An engine stage for use in a thermodynamic engine system, said engine stage comprising;

a constant volume heat exchanger means adapted to be coupled to a relatively cold primary working fluid and a relatively warm secondary fluid for transferring heat from said secondary fluid to said primary working fluid while maintaining the volume of said primary working fluid constant, said heat exchanger means having first and second inlets adapted to be coupled to said primary fluid substantially and said secondary fluid, respectively, a primary working fluid outlet and a secondary fluid outlet;

and an expansion engine for converting heated primary working fluid to mechanical energy, said expansion engine having an inlet port coupled to said primary working fluid outlet of said constant volume heat exchanger means and an outlet port.

10. The apparatus of claim 9 wherein said constant volume heat exchanger means comprises a housing providing an enclosed chamber, said chamber having a wall surface portion with a sustantially constant radius of curvature $R_1$ in the region along the direction of primary working fluid flow between said primary working fluid inlet and said primary working fluid outlet, said housing having a secondary fluid passage coupled to said secondary fluid inlet and said secondary fluid outlet for permitting flow of said secondary fluid therethrough, the portion of said housing between said secondary fluid passage and said wall surface portion defining a thermal transfer wall; and a substantially cylindrical rotor rotatably mounted in said chamber having a plurality of radially outwardly biased members for defining constant volume segments in concert with said wall surface portion and the outer surface portion of said rotor.

11. The apparatus of claim 10 wherein said secondary fluid inlet, passage and outlet are arranged to permit counterflow of said secondary fluid therealong with respect to the flow of said primary working fluid.

12. The apparatus of claim 9 wherein said expansion engine comprises a housing providing an enclosed chamber, said chamber having a first wall surface portion with an increasing radius of curvature in the region along the direction of fluid flow between said inlet port and said outlet port, and a second wall surface portion with a substantially constant radius of curvature $R_2$ in the region between said outlet port and said inlet port; and a substantially cylindrical rotor rotatably mounted in said chamber having a plurality of radially outwardly biased members for defining volume segments in concert with said wall surface portion and the outer surface of said rotor, said volume segments increasing in magnitude along said first wall portion in said direction of fluid flow, said rotor having a radius of curvature of the order of $R_2$.

13. The apparatus of claim 9 further including an additional constant volume heat exchanger means for transferring heat from said secondary fluid to said primary working fluid while maintaining the volume of said primary working fluid constant, said additional heat exchanger means having first and second inlets adapted to be coupled to said primary and secondary fluids, respectively, each said heat exchanger means comprising a housing providing an enclosed chamber, said chamber having a wall surface portion with a substantially constant radius of curvature $R_1$ in the region along the direction of primary fluid flow between said primary working fluid inlet and said primary working fluid outlet, said housing having a secondary fluid passage coupled to said secondary fluid inlet and said secondary fluid outlet for permitting flow of said secondary fluid therethrough, the portion of said housing between said secondary fluid passage and said wall surface passage defining a thermal transfer wall; and a substantially cylindrical rotor rotatably mounted in said chamber having a plurality of radially outwardly biased members for defining constant volume segments in concert with said wall surface portion and the outer surface of said rotor;

a common work shaft;

said heat exchangers and said heat expansion engine being coupled to said work shaft with said heat exchangers flanking said expansion engine.

14. The apparatus of claim 13 wherein said secondary fluid inlet, passage and outlet of each of said heat exchanger means are arranged to permit counterflow of secondary fluid therethrough with respect to the flow of said primary working fluid.

15. The apparatus of claim 13 wherein said expansion engine comprises a housing having a pair of generally opposed inlet ports and outlet ports and providing an enclosed chamber, said chamber having a first pair of generally opposed wall surface portions, each with an increasing radius of curvature in the region along the direction of fluid flow between one of said inlet ports and one of said outlet ports, and a second pair of generally opposed wall surface portions each with a substantially constant radius of curvature $R_2$ in the region between one of said outlet ports and one of said inlet ports; and a substantially cylindrical rotor rotatably mounted in said chamber, said rotor having a radius of curvature of of the order of $R_2$.

16. The apparatus of claim 9 wherein said engine stage includes a single housing providing an enclosed chamber, said chamber having a first wall surface portion with a substantially constant radius $R_1$ in the region along the direction of primary fluid flow from said primary working fluid inlet to an intermediate location, said housing having a secondary fluid passage coupled to said secondary fluid inlet and said secondary fluid outlet for permitting flow of said secondary fluid therethrough, the portion of said housing between said secondary fluid passage and said first wall surface portion defining an thermal transfer wall, said chamber having a second wall surface portion with an increasing radius of curvature in the region along said direction of fluid flow from said intermediate location to said primary working fluid outlet, and a third wall surface portion with a substantially constant radius of curvature $R_2$ of magnitude less than $R_1$ in the region between said outlet port and said inlet port; and a substantially cylindrical rotor rotatably mounted in said chamber having a plurality of radially outwardly biased members for defining constant volume segments in concert with said first wall surface portion and the surface of said rotor and variable volume segments of increasing magnitude with said second wall surface portion and the surface of said rotor.

17. A thermodynamic engine system for providing mechanical energy from the thermal potential energy comprising:

a primary working fluid loop adapted to be coupled to a source of primary working fluid;

a secondary fluid loop adapted to be coupled to a source of secondary fluid;

a work shaft; and a plurality of engine stages coupled to said work shaft, each said engine stage comprising a constant volume heat exchanger means for enabling heat transfer from said secondary fluid to said primary working fluid while maintaining the volume of said primary working fluid substantially constant, each said heat exchanger means having a primary working fluid inlet port, a primary working fluid outlet port, a secondary fluid inlet port and a secondary fluid outlet port, and an expansion engine coupled to said primary working fluid outlet port of said heat exchanger means for generating mechanical energy from heated primary working fluid coupled thereto, each said expansion engine having an inlet port coupled to the primary working fluid outlet port of the associated constant volume heat exchanger means and an outlet port coupled to the primary working fluid inlet port of the constant volume heat exchanger means of the next succeeding engine stage.

18. The system of claim 17 wherein said primary working fluid loop is an open loop and said secondary fluid loop is a closed loop for recycling said secondary fluid.

19. The system of claim 18 further including a plurality of preliminary heat exchanger means each coupled to said primary working fluid loop downstream of a different one of said engine stages for initially heating said primary working fluid to a temperature above the freezing temperature of said secondary fluid.

20. The system of claim 19 wherein said primary working fluid loop includes means for pumping said primary working fluid from the inlet of said primary working fluid loop to the first of said plurality of preliminary heat exchanger means.

21. The system of claim 20 wherein said pumping means is coupled to said work shaft.

22. The system of claim 17 further including an additional heat exchanger means coupled to said secondary fluid loop upstream from each of said engine stages for transferring heat from a tertiary heat source to said secondary fluid, and means for pumping said secondary fluid from said additional heat exchanger means to said secondary fluid inlet of each of said engine stages.

23. The system of claim 22 wherein said secondary fluid pumping means is coupled to said work shaft.

24. The system of claim 17 further including engine starting means coupled to said primary working fluid loop having a reservoir for storing a quantity of said primary working fluid under pressure, and valve means for coupling said primary working fluid stored under pressure to one of said engine stages to provide an initial starting surge of primary working fluid.

25. A method of providing mechanical energy from thermal potential energy comprising:

a. transferring thermal energy from a relatively warm source to a portion of a quantity of relatively cold primary working fluid while maintaining the volume of said portion of primary working fluid substantially constant; and b. converting the thermal energy transferred to said primary working fluid to mechanical energy.

26. The method of claim 25 wherein said step of transferring includes the steps of:

i. conducting said primary working fluid through a constant volume region, and ii. conducting said relatively warm source through a thermal transfer region in thermal contact with said primary working fluid.

27. The method of claim 25 wherein said step of converting includes the steps of:

i. permitting said portion of said primary working fluid to expand after said step of transferring, and ii. utilizing the expansion of said portion of said primary working fluid to propel a mechanical device.

28. The method of claim 25 wherein said step of transferring includes the steps of:

i. transferring thermal energy from said relatively warm source to a secondary fluid, and ii. transferring a portion of the thermal energy in said secondary fluid to said portion of said primary working fluid.

29. In a thermodynamic device for converting thermal potential energy stored in a relatively low temperature primary working fluid to a different energy form and having at least one engine stage including a heat exchanger for supplying heat energy to said primary working fluid, the improvement wherein said heat exchanger includes stationary means providing a fluid path for a relatively high temperature secondary fluid, means for circulating said secondary fluid along said fluid path, and thermal transfer means providing a thermal transfer region between said secondary and said primary working fluids, said thermal transfer region being shielded from ambient to prevent formation of ice.

30. The device of claim 29, wherein said fluid path is closed.

31. A thermodynamic engine system for converting thermal potential energy to mechanical energy, said system including:

a primary working fluid path adapted to be coupled to an external source of primary working fluid stored at a relatively low temperature;

a stationary secondary fluid path for a relatively high temperature secondary fluid;

means for circulating said secondary fluid in said fluid path;

a heat exchanger providing a thermal transfer region between a portion of said primary working fluid path and a portion of said secondary fluid path, said thermal transfer region being shielded from ambient to prevent the accumulation of ice; and an engine coupled to said heat exchanger for developing mechanical energy from heated primary working fluid coupled thereto from said heat exchanger.

32. The system of claim 31 wherein said heat exchanger comprises a housing having first and second fluid flow channels formed therein to provide portions of said primary working fluid path and said secondary fluid path, and a substantially solid wall between said first and second channels for providing said thermal transfer region.

33. The system of claim 32 wherein said housing is partially cylindrical and said first flow channel describes a partially cylindrical path within said housing.

34. A method of maintaining the thermal transfer efficiency of a thermodynamic device employing a relatively low temperature primary working fluid, said method comprising the steps of:

a. conducting said primary working fluid along a primary working fluid path;

b. conducting a relatively high temperature secondary fluid along a secondary fluid path formed in a stationary member; and c. transferring heat from said secondary fluid to said primary working fluid through a thermal transfer region shielded from ambient to preclude the formation of ice.

35. The method of claim 34 wherein said secondary fluid path is closed.

36. The method of claim 34 wherein said thermal transfer region is substantially solid.

37. The method of claim 27 wherein said step (i) of expanding is performed substantially isentropically.

* * * * *